US007198467B2

(12) United States Patent
Keith et al.

(10) Patent No.: US 7,198,467 B2
(45) Date of Patent: Apr. 3, 2007

(54) METHOD AND APPARATUS FOR COOLING GAS TURBINE ENGINE ROTOR BLADES

(75) Inventors: Sean Robert Keith, Fairfield, OH (US); Michael Joseph Danowski, Cincinnati, OH (US); Leslie Eugene Leeke, Jr., Burlington, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/909,199

(22) Filed: Jul. 30, 2004

(65) Prior Publication Data

US 2006/0024151 A1 Feb. 2, 2006

(51) Int. Cl.
*F01S 5/18* (2006.01)

(52) U.S. Cl. ..... 416/96 R; 416/193 A

(58) Field of Classification Search ..... 416/96 R, 416/193 A

See application file for complete search history.

(56) References Cited

U.S. PATENT DOCUMENTS 4,604,031 A 8/1986 Moss et al.
4,940,388 A 7/1990 Lilleker et al.
5,382,135 A 1/1995 Green
5,639,216 A 6/1997 McLaurin et al.
5,848,876 A 12/1998 Tomita
6,017,189 A * 1/2000 Judet et al. ..... 416/97 R
6,071,075 A * 6/2000 Tomita et al. ..... 416/97 R
6,079,946 A 6/2000 Suenaga et al.
6,092,991 A 7/2000 Tomita et al.
6,120,249 A 9/2000 Hultgren et al.
6,132,173 A 10/2000 Tomita et al.
6,196,799 B1 3/2001 Fukue et al.
6,210,111 B1 4/2001 Liang
6,227,804 B1 5/2001 Koga et al.
6,254,345 B1 7/2001 Harris et al.
6,402,471 B1 6/2002 Demers et al.
6,416,284 B1 7/2002 Demers et al.
6,422,811 B1 7/2002 Beeck et al.
6,457,935 B1 * 10/2002 Antunes et al. ..... 415/115
6,478,540 B2 * 11/2002 Abuaf et al. ..... 416/1
6,508,620 B2 1/2003 Sreekanth et al.
6,619,912 B2 9/2003 Tiemann
6,641,360 B2 11/2003 Beeck et al.
6,644,920 B2 11/2003 Beeck et al.
6,719,529 B2 4/2004 Tiemann

* cited by examiner

*Primary Examiner*—Edward K. Look
*Assistant Examiner*—Nathan Wiehe
(74) *Attorney, Agent, or Firm*—William Scott Andes; Armstrong Teasdale LLP

(57) ABSTRACT

A method for fabricating a turbine rotor blade includes casting a turbine rotor blade including a dovetail, a platform having an outer surface, an inner surface, and a cast-in plenum defined between the outer surface and the inner surface, and an airfoil, and forming a plurality of openings between the platform inner surface and the platform outer surface to facilitate cooling an exterior surface of the platform.

19 Claims, 9 Drawing Sheets

METHOD AND APPARATUS FOR COOLING GAS TURBINE ENGINE ROTOR BLADES

BACKGROUND OF THE INVENTION

This application relates generally to gas turbine engines and, more particularly, to methods and apparatus for cooling gas turbine engine rotor blades.

At least some known rotor assemblies include at least one row of circumferentially-spaced rotor blades. Each rotor blade includes an airfoil that includes a pressure side, and a suction side connected together at leading and trailing edges. Each airfoil extends radially outward from a rotor blade platform to a tip, and also includes a dovetail that extends radially inward from a shank extending between the platform and the dovetail. The dovetail is used to couple the rotor blade within the rotor assembly to a rotor disk or spool. At least some known rotor blades are hollow such that an internal cooling cavity is defined at least partially by the airfoil, through the platform, the shank, and the dovetail.

During operation, because the airfoil portion of each blade is exposed to higher temperatures than the dovetail portion, temperature gradients may develop at the interface between the airfoil and the platform, and/or between the shank and the platform. Over time, thermal strain generated by such temperature gradients may induce compressive thermal stresses to the blade platform. Moreover, over time, the increased operating temperature of the platform may cause platform oxidation, platform cracking, and/or platform creep deflection, which may shorten the useful life of the rotor blade.

To facilitate reducing the effects of the high temperatures in the platform region, shank cavity air and/or a mixture of blade cooling air and shank cavity air is introduced into a region below the platform region to facilitate cooling the platform. However, in at least some known turbines, the shank cavity air is significantly warmer than the blade cooling air. Moreover, because the platform cooling holes are not accessible to each region of the platform, the cooling air may not be provided uniformly to all regions of the platform to facilitate reducing an operating temperature of the platform region.

BRIEF SUMMARY OF THE INVENTION

In one aspect, a method for fabricating a turbine rotor blade is provided. The method includes casting a turbine rotor blade including a dovetail, a platform having an outer surface, an inner surface, and a cast-in plenum defined between the outer surface and the inner surface, and an airfoil, and forming a plurality of openings between the platform inner surface and the platform outer surface to facilitate cooling an exterior surface of the platform.

In another aspect, a turbine rotor blade is provided. The turbine rotor blade includes a dovetail, a platform coupled to the dovetail, wherein the platform includes a cast-in plenum formed within the platform, an airfoil coupled to the platform, and a cooling source coupled in flow communication to the cast-in plenum.

In a further aspect, a gas turbine engine is provided. The gas turbine engine includes a turbine rotor, and a plurality of circumferentially-spaced rotor blades coupled to the turbine rotor, wherein each rotor blade includes a dovetail, a platform coupled to the dovetail, wherein the platform includes a cast-in plenum formed within the platform, an airfoil coupled to the platform, and a cooling source coupled in flow communication to the cast-in plenum.

DETAILED DESCRIPTION OF THE INVENTION

Figure 1:
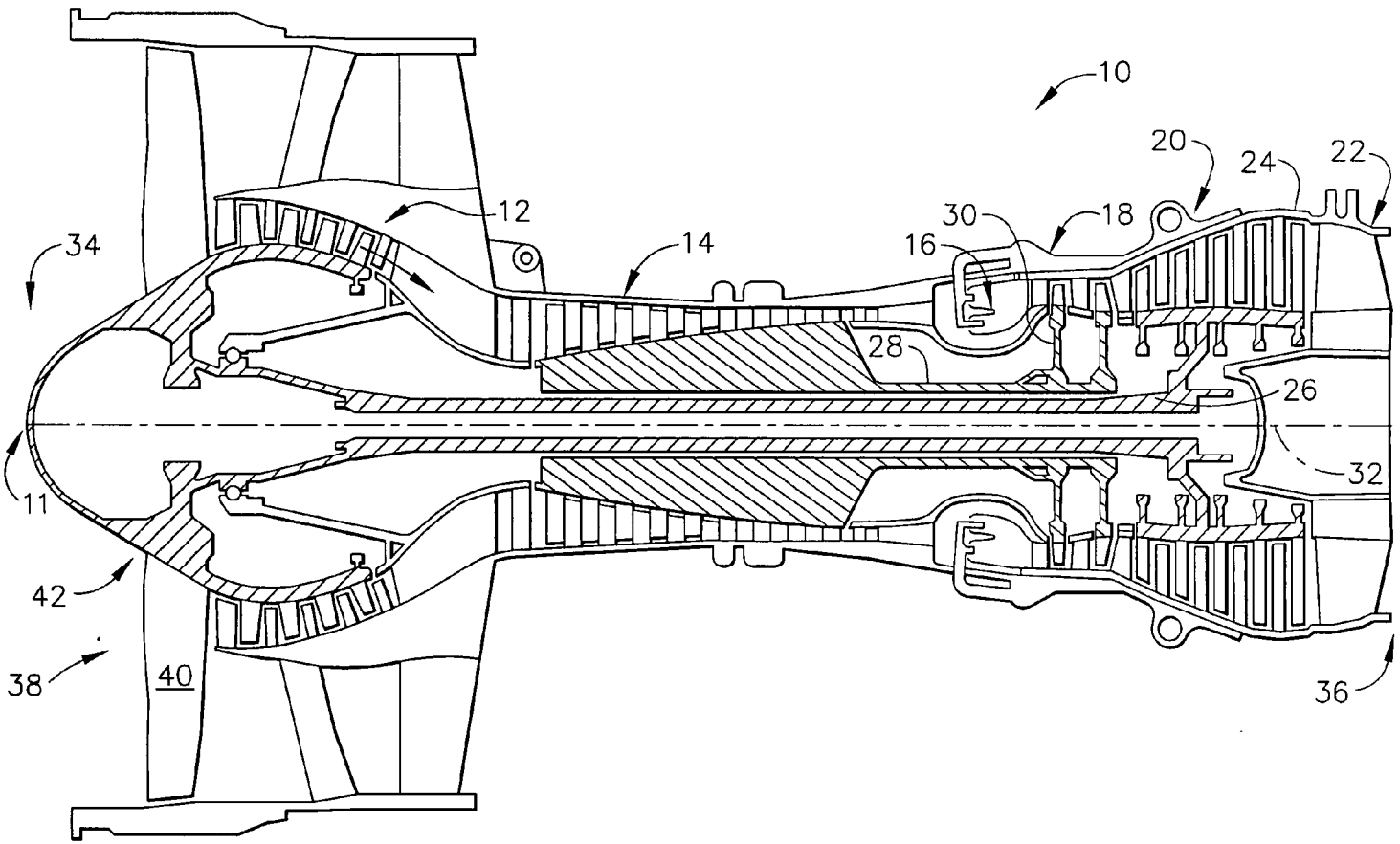
FIG. 1 is a schematic illustration of an exemplary gas turbine engine.

FIG. 1 is a schematic illustration of an exemplary gas turbine engine 10 including a rotor 11 that includes a low-pressure compressor 12, a high-pressure compressor 14, and a combustor 16. Engine 10 also includes a high-pressure turbine (HPT) 18, a low-pressure turbine 20, an exhaust frame 22 and a casing 24. A first shaft 26 couples low-pressure compressor 12 and low-pressure turbine 20, and a second shaft 28 couples high-pressure compressor 14 and high-pressure turbine 18. Engine 10 has an axis of symmetry 32 extending from an upstream side 34 of engine 10 aft to a downstream side 36 of engine 10. Rotor 11 also includes a fan 38, which includes at least one row of airfoil-shaped fan blades 40 attached to a hub member or disk 42. In one embodiment, gas turbine engine 10 is a GE90 engine commercially available from General Electric Company, Cincinnati, Ohio.

In operation, air flows through low-pressure compressor 12 and compressed air is supplied to high-pressure compressor 14. Highly compressed air is delivered to combustor 16. Combustion gases from combustor 16 propel turbines 18 and 20. High pressure turbine 18 rotates second shaft 28 and high pressure compressor 14, while low pressure turbine 20 rotates first shaft 26 and low pressure compressor 12 about axis 32. During some engine operations, a high pressure turbine blade may be subjected to a relatively large thermal gradient through the platform, i.e. (hot on top, cool on the bottom) causing relatively high tensile stresses at a trailing edge root of the airfoil which may result in a mechanical failure of the high pressure turbine blade. Improved platform cooling facilitates reducing the thermal gradient and therefore reduces the trailing edge stresses. Rotor blades may also experience concave platform cracking and bowing from creep deformation due to the high platform temperatures. Improved platform cooling described herein facilitates reducing these distress modes as well.

Figure 2:
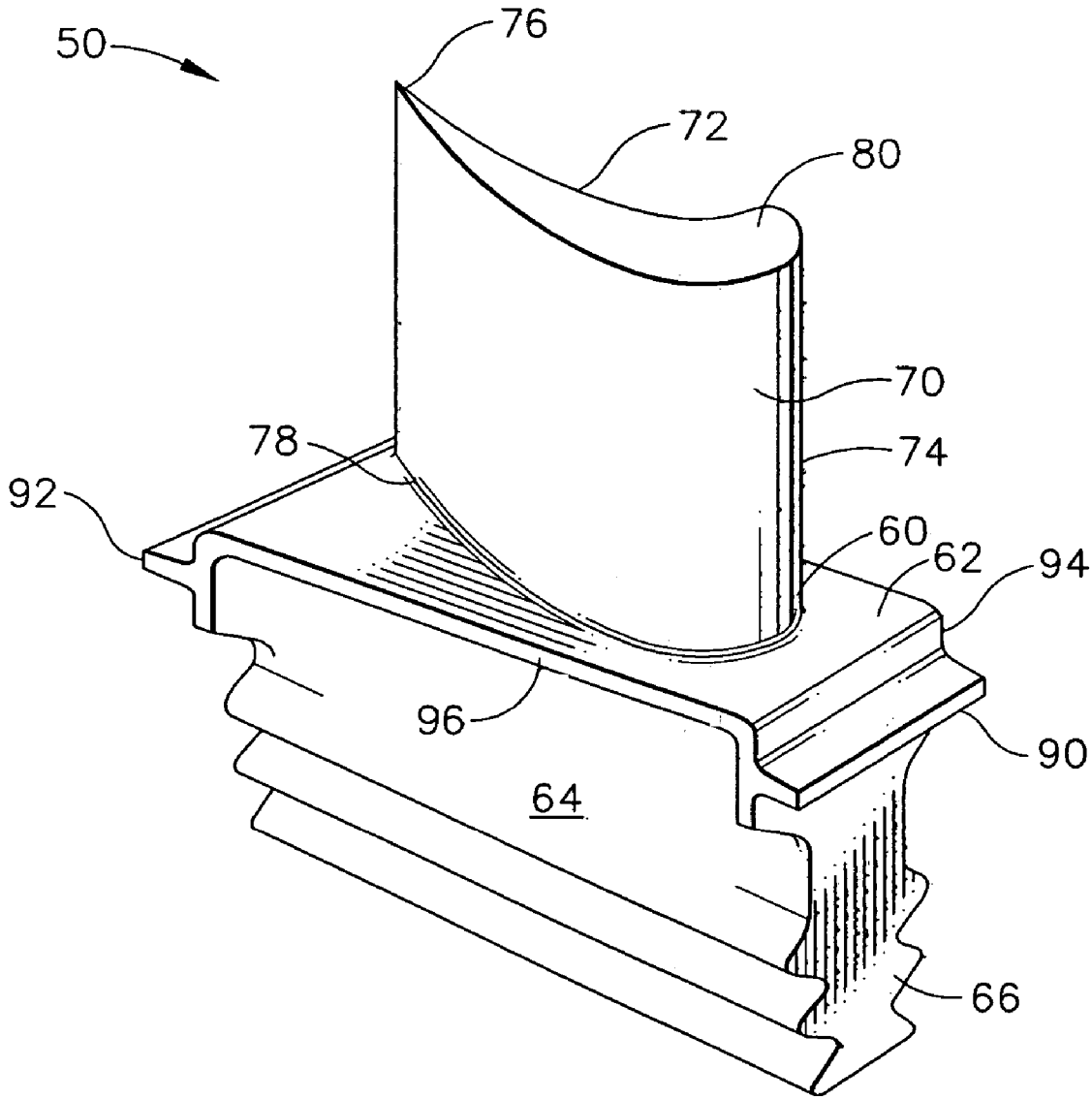
FIG. 2 is an enlarged perspective view of an exemplary rotor blade that may be used with the gas turbine engine shown in FIG. 1.

FIG. 2 is an enlarged perspective view of a turbine rotor blade 50 that may be used with gas turbine engine 10 (shown in FIG. 1). In the exemplary embodiment, blade 50 has been modified to include the features described herein. When coupled within the rotor assembly, each rotor blade 50 is coupled to a rotor disk 30 (shown in FIG. 1) that is rotatably coupled to a rotor shaft, such as shaft 28 (shown in FIG. 1).

In an alternative embodiment, blades 50 are mounted within a rotor spool (not shown). In the exemplary embodiment, circumferentially adjacent rotor blades 50 are identical and each extends radially outward from rotor disk 30 and includes an airfoil 60, a platform 62, a shank 64, and a dovetail 66. In the exemplary embodiment, airfoil 60, platform 62, shank 64, and dovetail 66 are collectively known as a bucket.

Each airfoil 60 includes a first sidewall 70 and a second sidewall 72. First sidewall 70 is convex and defines a suction side of airfoil 60, and second sidewall 72 is concave and defines a pressure side of airfoil 60. Sidewalls 70 and 72 are joined together at a leading edge 74 and at an axially-spaced trailing edge 76 of airfoil 60. More specifically, airfoil trailing edge 76 is spaced chord-wise and downstream from airfoil leading edge 74.

First and second sidewalls 70 and 72, respectively, extend longitudinally or radially outward in span from a blade root 78 positioned adjacent platform 62, to an airfoil tip 80. Airfoil tip 80 defines a radially outer boundary of an internal cooling chamber (not shown) that is defined within blades 50. More specifically, the internal cooling chamber is bounded within airfoil 60 between sidewalls 70 and 72, and extends through platform 62 and through shank 64 and into dovetail 66 to facilitate cooling airfoil 60.

Platform 62 extends between airfoil 60 and shank 64 such that each airfoil 60 extends radially outward from each respective platform 62. Shank 64 extends radially inwardly from platform 62 to dovetail 66, and dovetail 66 extends radially inwardly from shank 64 to facilitate securing rotor blades 50 to rotor disk 30. Platform 62 also includes an upstream side or skirt 90 and a downstream side or skirt 92 that are connected together with a pressure-side edge 94 and an opposite suction-side edge 96.

Figure 3:
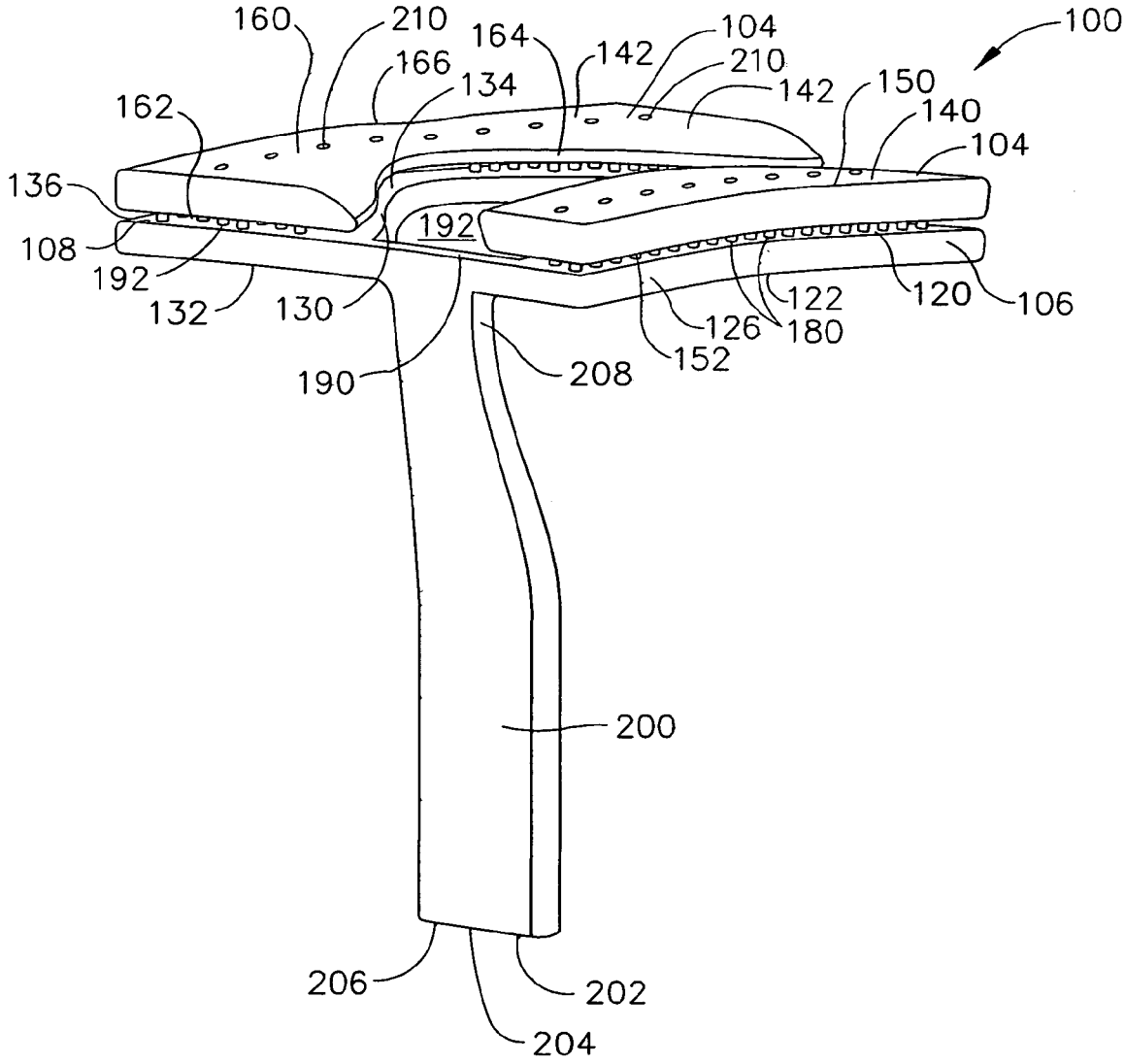
FIG. 3 is a perspective view of an exemplary cast-in plenum.
Figure 4:
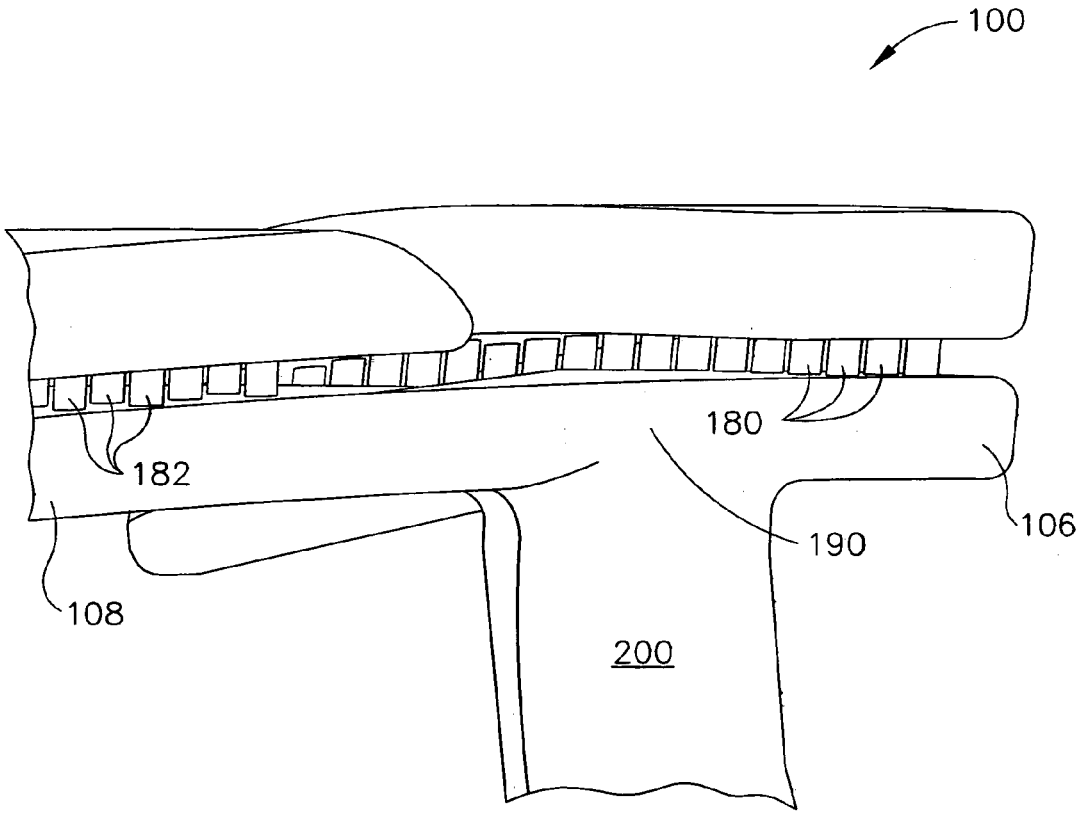
FIG. 4 is a side perspective view of the plenum shown in FIG. 3.
Figure 5:
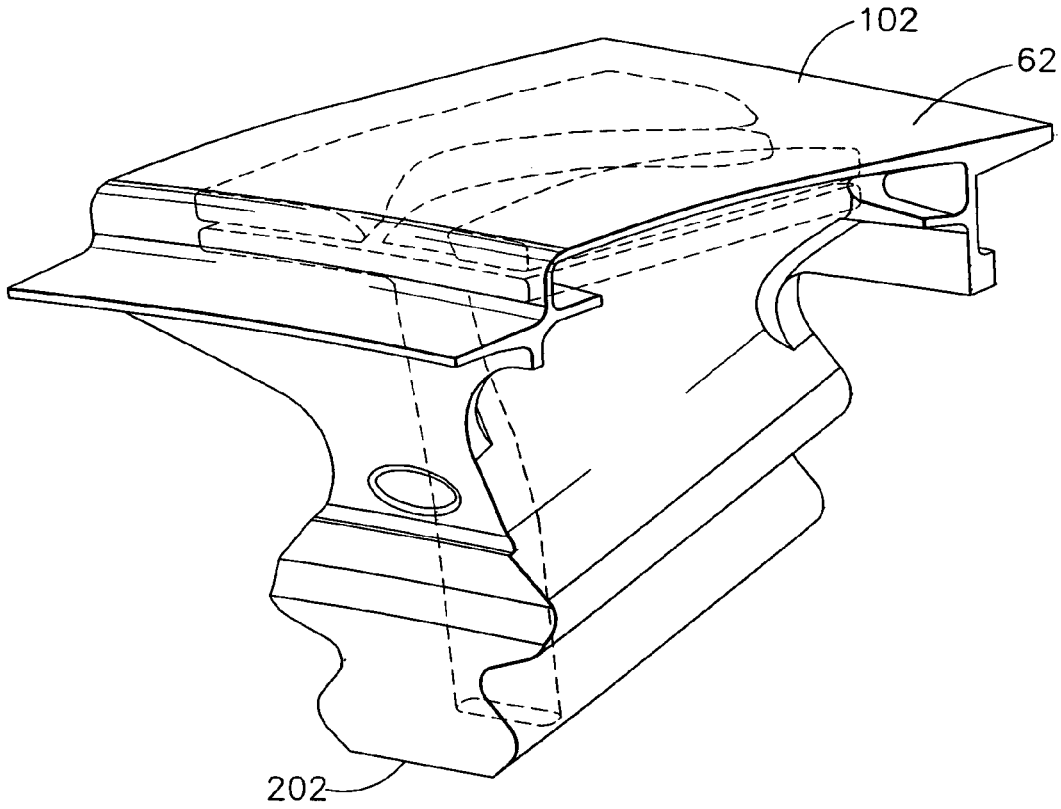
FIG. 5 is a side perspective view of the rotor blade shown in FIG. 2 and including the plenum shown in FIG. 3.
Figure 6:
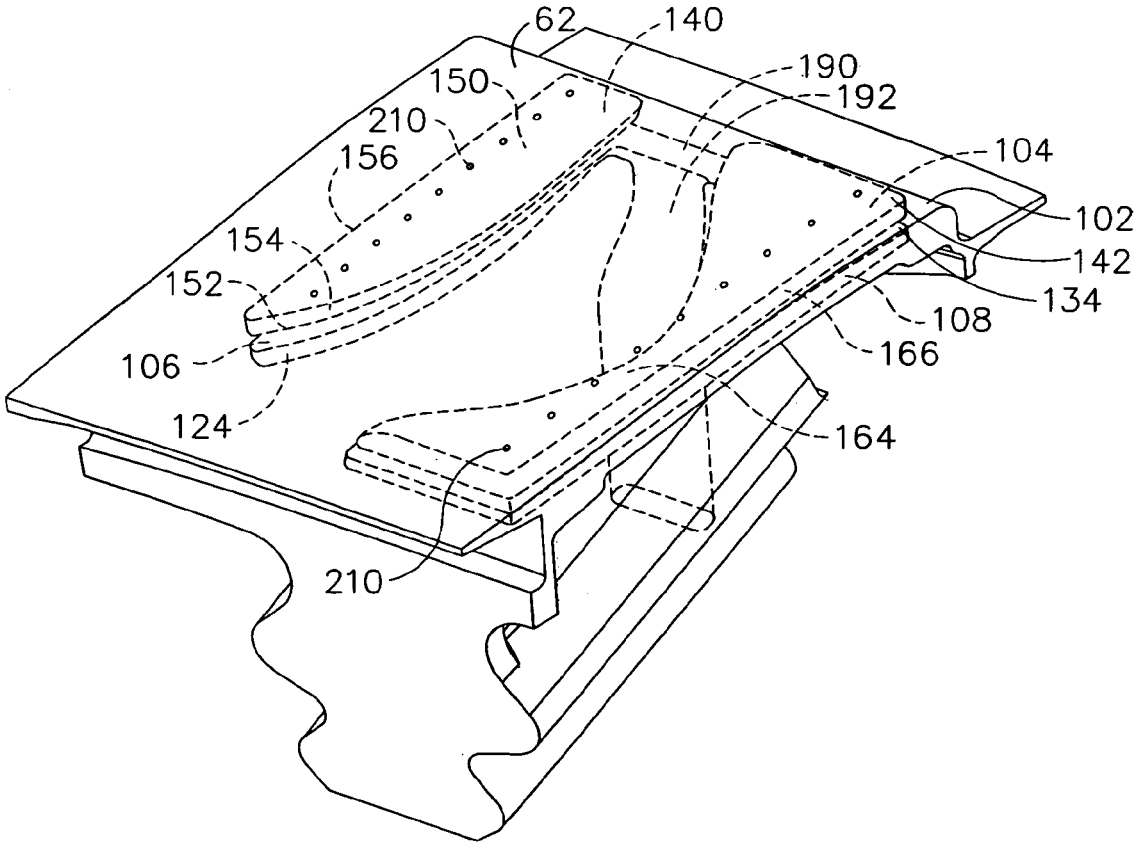
FIG. 6 is a top perspective view of the rotor blade shown in FIG. 5.
Figure 7:
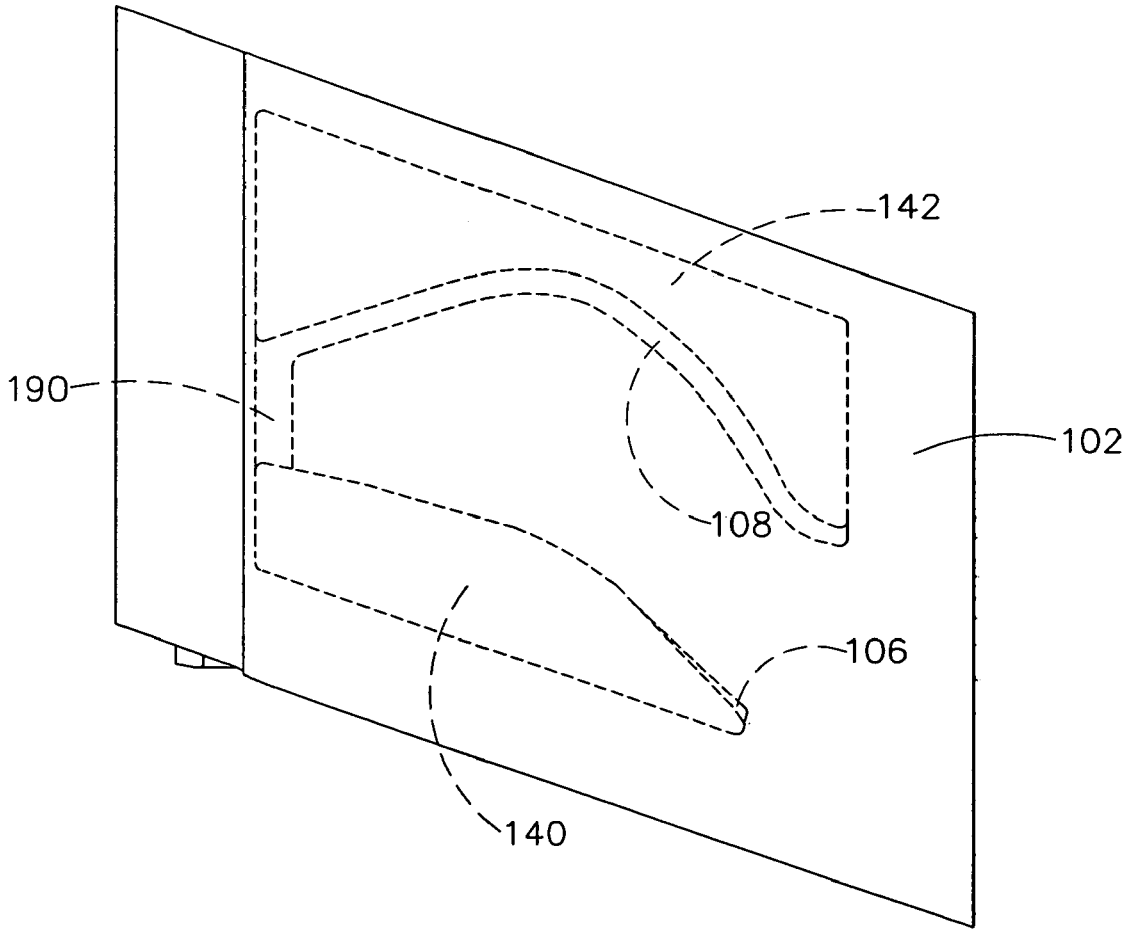
FIG. 7 is a top plan view of the rotor blade shown in FIG. 5.

FIG. 3 is a perspective view of an exemplary cast-in plenum 100 and FIG. 4 is a side perspective view of plenum 100. FIG. 5 is a side perspective view of rotor blade 50 including cast-in plenum 100 and FIG. 6 is a top perspective view of rotor blade 50 including cast-in plenum 100. FIG. 7 is a top plan view of rotor blade 50 including cast-in plenum 100. In the exemplary embodiment, platform 62 includes an outer surface 102 and an inner surface 104 that defines cast-in plenum 100. More specifically, following casting and coring of turbine rotor blade 50, inner surface 104 defines cast-in plenum 100 entirely within outer surface 102. Accordingly, in the exemplary embodiment, cast-in plenum 100 is formed unitarily with, and is completely enclosed within, rotor blade 50.

Cast-in plenum 100 includes a first portion 106 and a second portion 108. First portion 106 includes an upper surface 120, a lower surface 122, a first side 124, and a second side 126 that are each defined by inner surface 104. In the exemplary embodiment, first side 124 has a generally concave shape that substantially mirrors a contour of second sidewall 72. Second portion 108 includes an upper surface 130, a lower surface 132, a first side 134, and a second side 136 that are each defined by inner surface 104. In the exemplary embodiment, first side 134 has a generally convex shape that substantially mirrors a contour of first sidewall 70.

In the exemplary embodiment, cast-in plenum 100 also includes a third portion 140 and a fourth portion 142. Third portion 140 includes an upper surface 150, a lower surface 152, a first side 154, and a second side 156 that are each defined by inner surface 104. In the exemplary embodiment, first side 154 has a generally concave shape that substantially mirrors a contour of second sidewall 72. Fourth portion 142 includes an upper surface 160, a lower surface 162, a first side 164, and a second side 166 each defined by inner surface 104. In the exemplary embodiment, first side 164 has a generally convex shape that substantially mirrors a contour of first sidewall 70.

Cast-in plenum 100 also includes a first plurality of openings 180 that are defined within substantially solid portion 192 and extend between first and third portions 106 and 140, such that first portion 106 is coupled in flow communication with third portion 140. Plenum 100 also includes a second plurality of openings 182 that extend between second and fourth portions 108 and 142 such that second portion 108 is coupled in flow communication with fourth portion 142. In the exemplary embodiment, cast-in plenum 100 also includes a fifth portion 190 that is coupled in flow communication with plenums 106 and 108 such that plenums 106 and 108 define a substantially U-shaped plenum as shown in FIGS. 3–7.

In the exemplary embodiment, platform 62 includes a substantially solid portion 192 that extends around and between first portion 106, second portion 108, third portion 140, and fourth portion 142. More specifically, turbine rotor blade 50 is cored between first portion 106, second portion 108, third portion 140, and fourth portion 142 such that a substantially solid base 192 is defined between airfoil 60, platform 62, and shank 64 and such that plenums 106 and 108 define a substantially U-shaped plenum as shown in FIGS. 3–7. Accordingly, fabricating rotor blade 50 such that cast-in plenum 100 is contained entirely within rotor blade 50 facilitates increasing the structural integrity of turbine rotor blade 50.

Turbine rotor blade 50 also includes a channel 200 that extends from a lower surface 202 of dovetail 66 to cast-in plenum 100. More specifically, channel 200 includes an opening 204 that extends through shank 64 such that lower surface 202 is coupled in flow communication with cast-in plenum 100. Channel 200 includes a first end 206 and a second end 208 wherein second end 208 is coupled in flow communication to fifth portion 190.

Turbine rotor blade 50 also includes a plurality of openings 210 formed in flow communication with cast-in plenum 100 and extending between cast-in plenum 100 and platform outer surface 102. Openings 210 facilitate cooling platform 62. In the exemplary embodiment, openings 210 extend between cast-in plenum 100 and platform outer surface 102. More specifically, openings 210 extend between third and fourth plenum upper surfaces 150 and 160 and platform outer surface 102. In another embodiment, openings 210 extend between cast-in plenum 100 and at least one of first plenum second side 126 and/or third plenum second side 156. In the exemplary embodiment, openings 210 are sized to enable a predetermined quantity of cooling airflow to be discharged therethrough to facilitate cooling platform 62.

During fabrication of cast-in plenum 100, a core (not shown) is cast into turbine blade 50. The core is fabricated by injecting a liquid ceramic and graphite slurry into a core die (not shown). The slurry is heated to form a solid ceramic plenum core. The core is suspended in an turbine blade die (not shown) and hot wax is injected into the turbine blade die to surround the ceramic core. The hot wax solidifies and forms a turbine blade with the ceramic core suspended in the blade platform.

The wax turbine blade with the ceramic core is then dipped in a ceramic slurry and allowed to dry. This procedure is repeated several times such that a shell is formed over the wax turbine blade. The wax is then melted out of the shell leaving a mold with a core suspended inside, and into which molten metal is poured. After the metal has solidified the shell is broken away and the core removed.

During engine operation, and in the exemplary embodiment, cooling air entering channel first end 206 is channeled through channel 200, fifth portion 190, and discharged into first and second portions 106 and 108 respectively. The cooling air is then channeled from first and second portions 106 and 108, through first and second plurality of openings 180 and 182 respectively, into third and fourth portions 140 and 142 where a first portion of the cooling air impinges on a lower interior surface of platform 62. A second portion of cooling air is discharged from third and fourth portions 140 and 142 through plurality of openings 210 to form a thin film of cooling air on platform outer surface 102 to facilitate reducing an operating temperature of platform 62. Moreover, the cooling air discharged from openings 210 facilitates reducing thermal strains induced to platform 62. Openings 210 are selectively positioned around an outer periphery of platform 62 to facilitate compressor cooling air being channeled towards selected areas of platform 62 to facilitate optimizing the cooling of platform 62. Accordingly, when rotor blades 50 are coupled within the rotor assembly, channel 200 enables compressor discharge air to flow into cast-in plenum 100 and through openings 180, 182, and 210 to facilitate reducing an operating temperature of an interior and exterior surface of platform 62.

In an alternative embodiment, cooling air is channeled through an opening (not shown) defined in an end or a side of either shank 64 and/or dovetail 66 and then channeled through channel 200, fifth portion 190, and discharged into first and second portions 106 and 108 respectively. The cooling air is then channeled from first and second portions 106 and 108, through first and second plurality of openings 180 and 182 respectively, into third and fourth portions 140 and 142 where a first portion of the cooling air impinges on a lower interior surface of platform 62. A second portion of cooling air is discharged from third and fourth portions 140 and 142 through plurality of openings 210 to form a thin film of cooling air on platform outer surface 102 to facilitate reducing an operating temperature of platform 62.

Figure 8:
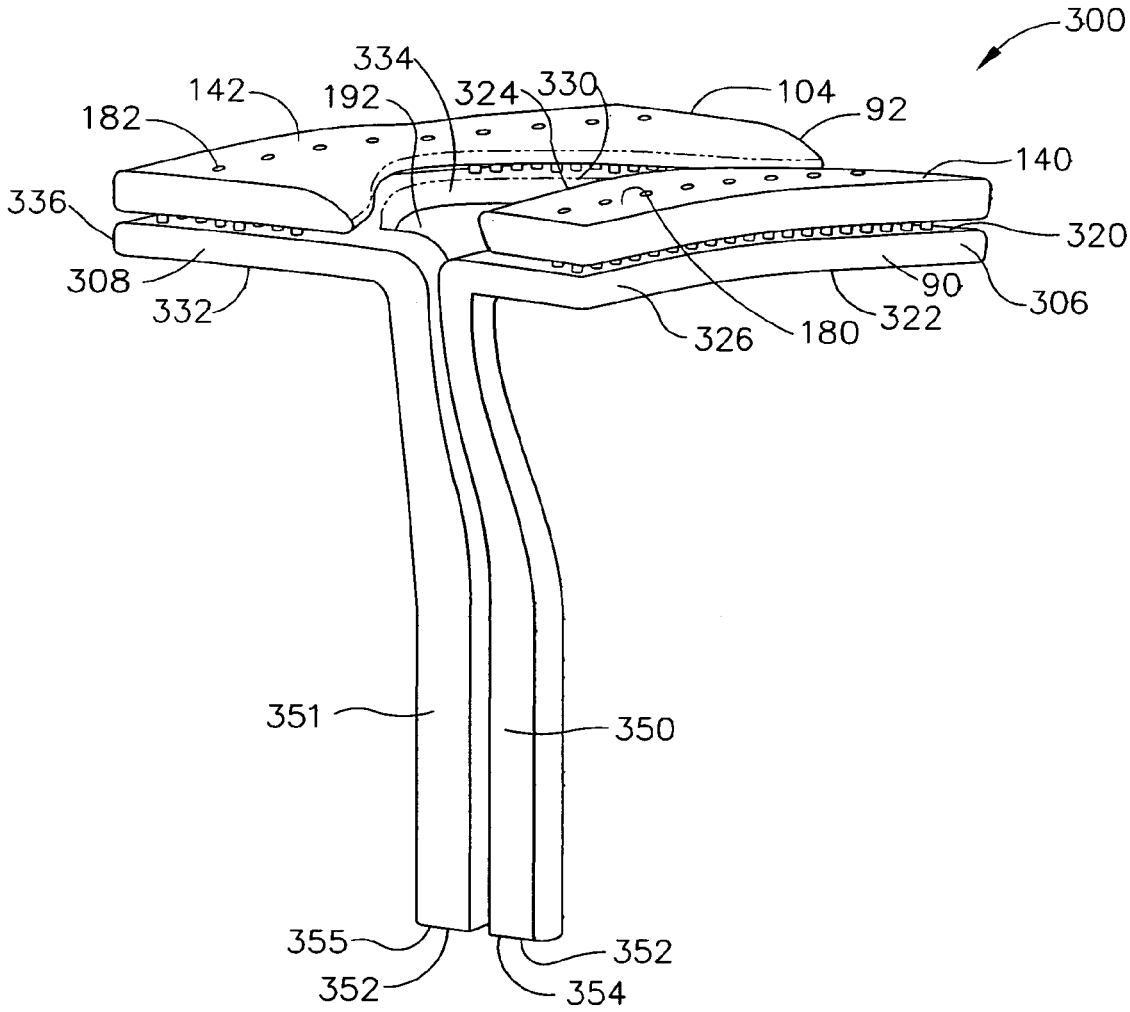
FIG. 8 is a perspective view of an alternative embodiment of a cast-in plenum.

FIG. 8 is a perspective view of an alternative embodiment of a cast-in plenum 300. Cast-in plenum 300 is substantially similar to cast-in plenum 100, (shown in FIGS. 3–7) and components of cast-in plenum 300 that are identical to components of cast-in plenum 100 are identified in FIG. 8 using the same reference numerals used in FIGS. 3–7. In the alternative embodiment, cast-in plenum 300 is formed unitarily with and completely enclosed within rotor blade 50. Cast-in plenum 300 includes a first portion 306, a second portion 308, third portion 140 and fourth portion 142. First portion 306 includes an upper surface 320, a lower surface 322, a first side 324, and a second side 326 that are each defined by inner surface 104. In the alternative embodiment, first side 324 has a generally concave shape that substantially mirrors a contour of second sidewall 72. Second portion 308 includes an upper surface 330, a lower surface 332, a first side 334, and a second side 336 each defined by inner surface 104. In the alternative embodiment, first side 334 has a generally convex shape that substantially mirrors a contour of first sidewall 70.

In the first alternative embodiment, cast-in plenum 300 also includes third portion 140 and fourth portion 142. Third portion 140 includes upper surface 150, lower surface 152, first side 154, and second side 156 that are each defined by inner surface 104. In the exemplary embodiment, first side 154 has a generally concave shape that substantially mirrors a contour of second sidewall 72. Fourth portion 142 includes upper surface 160, lower surface 162, first side 164, and second side 166 each defined by inner surface 104. In the exemplary embodiment, first side 164 has a generally convex shape that substantially mirrors a contour of first sidewall 70.

Cast-in plenum 300 also includes first plurality of openings 180 that are defined within substantially solid portion 192 and extend between first and third portions 306 and 140 such that first portion 306 is coupled in flow communication with third portion 140 and such that plenum 300 also includes a second plurality of openings 182 that extend between second and fourth portions 308 and 142 such that second portion 308 is coupled in flow communication with fourth portion 142.

Turbine rotor blade 50 also includes a first channel 350 that extends from a lower surface 352 of dovetail 66 to first portion 306 and a second channel 351 that extends from lower surface 352 of dovetail 66 to second portion 308. In one embodiment, first and second channels 350, 351 are formed unitarily. In another embodiment, first and second channels 350, 351 are formed as separate components such that first channel 350 channels cooling air to first portion 306 and second channel 351 channels cooling air to second portion 308. In the exemplary embodiment, first and second channels 350, 351 are positioned along at least one of upstream side or skirt 90 and downstream side or skirt 92. More specifically, channel 350 includes an opening 354 that extends through shank 64 such that lower surface 352 is coupled in flow communication with first portion 306 and channel 351 includes an opening 355 that extends through shank 64 such that lower surface 352 is coupled in flow communication with second portion 308.

During engine operation, cooling air entering a first channel 350 and second channel 351 are channeled through channels 350 and 351 respectively and discharged into first portion 306 and second portion 308 respectively. The cooling air is then channeled from first and second portions 306 and 308, through first and second plurality of openings 180 and 182 respectively, into third and fourth portions 140 and 142 where a first portion of the cooling air impinges on a lower interior surface of platform 62. A second portion of cooling air is discharged from third and fourth portions 140 and 142 through plurality of openings 210 to form a thin film of cooling air on platform outer surface 102 to facilitate reducing an operating temperature of platform 62. Moreover, the cooling air discharged from openings 210 facilitates reducing thermal strains induced to platform 62. Openings 210 are selectively positioned around an outer periphery of platform 62 to facilitate compressor cooling air being channeled towards selected areas of platform 62 to facilitate optimizing the cooling of platform 62. Accordingly, when rotor blades 50 are coupled within the rotor assembly, channels 350 and 351 enable compressor discharge air to flow into cast-in plenum 300 and through openings 180, 182, and 210 to facilitate reducing an operating temperature of an interior and exterior surface of platform 62.

Figure 9:
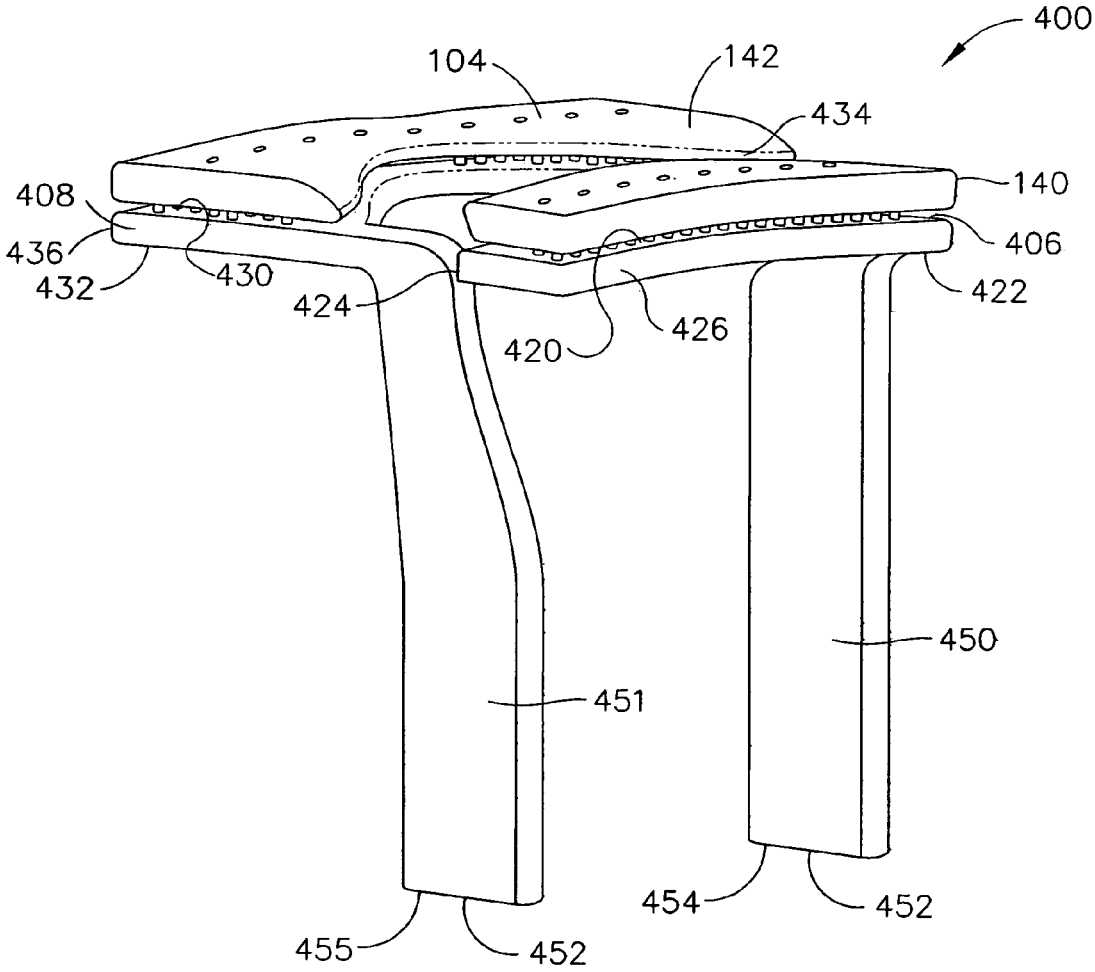
FIG. 9 is a perspective view of a second alternative embodiment of a cast-in plenum.

FIG. 9 is a perspective view of a second alternative embodiment of a cast-in plenum 400. Cast-in plenum 400 is substantially similar to cast-in plenum 100, (shown in FIGS. 3–7) and components of cast-in plenum 400 that are identical to components of cast-in plenum 100 are identified in FIG. 9 using the same reference numerals used in FIGS. 3–7. In the exemplary embodiment, cast-in plenum 400 is formed unitarily with, and is completely enclosed within, platform 62. Cast-in plenum 400 includes a first portion 406 and a second portion 408. First portion 406 includes an upper surface 420, a lower surface 422, a first side 424, and a second side 426 that are each defined by inner surface 104. In the exemplary embodiment, first side 424 has a generally concave shape that substantially mirrors a contour of second sidewall 72. Second portion 408 includes an upper surface 430, a lower surface 432, a first side 434, and a second side 436 each defined by inner surface 104. In the exemplary embodiment, first side 434 has a generally convex shape that substantially mirrors a contour of first sidewall 70.

Cast-in plenum 400 also includes third portion 140 and fourth portion 142. Third portion 140 includes upper surface 150, lower surface 152, first side 154, and second side 156 that are each defined by inner surface 104. In the exemplary embodiment, first side 154 has a generally concave shape that substantially mirrors a contour of second sidewall 72. Fourth portion 142 includes upper surface 160, lower surface 162, first side 164, and second side 166 that are each defined by inner surface 104. In the exemplary embodiment, first side 164 has a generally convex shape that substantially mirrors a contour of first sidewall 70.

In the second alternative embodiment, cast-in plenum 400 also includes first plurality of openings 180 that are defined within substantially solid portion 192 and extend between first and third portions 406 and 140 such that first portion 406 is coupled in flow communication with third portion 140. Plenum 400 also includes a second plurality of openings 182 that extend between second and fourth portions 408 and 142 such that second portion 408 is coupled in flow communication with fourth portion 142.

Turbine rotor blade 50 also includes a first channel 450 that extends from a lower surface 452 of dovetail 66 to first portion 406 and a second channel 451 that extends from lower surface 452 of dovetail 66 to second portion 408. In the exemplary embodiment, first and second channels 450, 451 are formed as separate components such that first channel 450 channels cooling air to first portion 406 and second channel 451 channels cooling air to second portion 408. In the exemplary embodiment, first channel 450 is positioned along at least one of upstream side or skirt 90 and downstream side or skirt 92, and second channel 451 is positioned along at least one of upstream side or skirt 90 and downstream side or skirt 92 opposite first channel 450. More specifically, channel 450 includes an opening 454 that extends through shank 64 such that lower surface 452 is coupled in flow communication with first portion 406, and second channel 451 includes an opening 455 that extends through shank 64 such that lower surface 452 is coupled in flow communication with second portion 408.

During engine operation, cooling air entering a first channel 450 and second channel 451 are channeled through channels 450 and 451 respectively and discharged into first portion 406 and second portion 408 respectively. The cooling air is then channeled from first and second portions 406 and 408, through first and second plurality of openings 180 and 182 respectively, into third and fourth portions 140 and 142 where a first portion of the cooling air impinges on a lower interior surface of platform 62. A second portion of cooling air is discharged from third and fourth portions 140 and 142 through plurality of openings 210 to form a thin film of cooling air on platform outer surface 102 to facilitate reducing an operating temperature of platform 62. Moreover, the cooling air discharged from openings 210 facilitates reducing thermal strains induced to platform 62. Openings 210 are selectively positioned around an outer periphery of platform 62 to facilitate compressor cooling air being channeled towards selected areas of platform 62 to facilitate optimizing the cooling of platform 62. Accordingly, when rotor blades 50 are coupled within the rotor assembly, channels 450 and 451 enable compressor discharge air to flow into cast-in plenum 400 and through openings 180, 182, and 210 to facilitate reducing an operating temperature of an interior and exterior surface of platform 62.

The above-described cooling circuits provide a cost-effective and reliable method for supplying cooling air to facilitate reducing an operating temperature of the rotor blade platform. More specifically, through cooling flow, thermal stresses induced within the platform, and the operating temperature of the platform is facilitated to be reduced. Accordingly, platform oxidation, platform cracking, and platform creep deflection is also facilitated to be reduced. As a result, the rotor blade cooling cast-in plenums facilitate extending a useful life of the rotor blades and improving the operating efficiency of the gas turbine engine in a cost-effective and reliable manner. Moreover, the method and apparatus described herein facilitate stabilizing platform hole cooling flow levels because the air is provided directly to the cast-in plenum via a dedicated channel, rather than relying on secondary airflows and/or leakages to facilitate cooling platform 62. Accordingly, the method and apparatus described herein facilitates eliminating the need for fabricating shank holes in the rotor blade.

Exemplary embodiments of rotor blades and rotor assemblies are described above in detail. The rotor blades are not limited to the specific embodiments described herein, but rather, components of each rotor blade may be utilized independently and separately from other components described herein. For example, each rotor blade cooling circuit component can also be used in combination with other rotor blades, and is not limited to practice with only rotor blade 50 as described herein. Rather, the present invention can be implemented and utilized in connection with many other blade and cooling circuit configurations. For example, the methods and apparatus can be equally applied to stator vanes such as, but not limited to an HPT vanes.

While the invention has been described in terms of various specific embodiments, those skilled in the art will recognize that the invention can be practiced with modification within the spirit and scope of the claims.

The invention claimed is:

1. A method for fabricating a rotor blade, said method comprising:

casting a rotor blade including a dovetail, a platform having an outer surface, an inner surface, and a cast-in plenum defined between the outer surface and the inner surface, the cast-in plenum including a first plenum portion, a second plenum portion, a third plenum portion that is coupled in flow communication with the first portion, and a fourth plenum portion that is coupled in flow communication with the second plenum portion; and forming a plurality of openings between the platform inner surface and the platform outer surface to facilitate cooling an exterior surface of the platform;

forming a first plurality of openings between the first plenum portion and the third plenum portion such that the first plenum portion is in flow communication with the third plenum portion; and forming a second plurality of openings between the second plenum portion and the fourth plenum portion such that the second plenum portion is in flow communication with the fourth plenum portion.

2. A method in accordance with claim 1 wherein casting a rotor blade further comprises casting a rotor blade that includes a fifth plenum portion that is coupled in flow communication with the first and the second plenum portions.

3. A method in accordance with claim 1 wherein casting a rotor blade further comprises casting a rotor blade that includes a first channel extending between at least one of a dovetail lower surface, a dovetail side surface, and a dovetail end surface, and the cast-in plenum first and second portions.

4. A method in accordance with claim 1 wherein casting a rotor blade further comprises casting a rotor blade that includes a first channel extending between a dovetail lower surface and the cast-in plenum first portion and a second channel extending between the dovetail lower surface and the cast-in plenum second portion.

5. A method in accordance with claim 1 wherein casting a rotor blade further comprises casting a rotor blade that includes a first channel extending between a dovetail lower surface and the cast-in plenum first portion, and a second channel extending between the dovetail lower surface and the cast-in plenum second portion, the first channel extending along at least one of a platform upstream side and a platform downstream side, the second channel extending along at least one of a platform upstream side and a platform downstream side opposite the first channel.

6. A method in accordance with claim 1 wherein casting a rotor blade further comprises casting a rotor blade that includes a first plenum portion and third plenum portion that each having a first side that is substantially concave, and a second and fourth plenum portion each having a first side that is substantially convex, the third and fourth plenum portions each including a plurality of openings selectively sized to facilitate channeling a predetermined quantity of cooling air to an exterior surface of the platform.

7. A method in accordance with claim 1 wherein casting a rotor blade further comprises casting a rotor blade that includes a platform including a substantially solid portion extending between the first, second, third, and fourth plenums such that the first and second plenums define a substantially U-shaped cast-in plenum extending around the solid portion and between the platform outer surface and the platform inner surface, wherein the solid portion facilitates increasing a structural integrity of the rotor blade.

8. A rotor blade comprising:

a dovetail;

a platform coupled to said dovetail, said platform comprising a cast-in plenum formed within said platform, said cast-in plenum comprising a first plenum portion, a second plenum portion, a third plenum portion that is coupled in flow communication with said first plenum portion, and a fourth plenum portion that is coupled in flow communication with said second plenum portion, said cast-in plenum further comprises a first plurality of openings extending between said first plenum portion and said third plenum portion such that said first plenum portion is in flow communication with said third plenum portion, and a second plurality of openings extending between said second plenum portion and said fourth plenum portion such that said second plenum portion is in flow communication with said fourth plenum portion;

an airfoil coupled to said platform; and a cooling source coupled in flow communication to said cast-in plenum.

9. A rotor blade in accordance with claim 8 wherein said cast-in plenum further comprises a fifth plenum portion that is coupled in flow communication with said first and said second plenum portions such that said first and second plenum portions define a a substantially U-shaped plenum.

10. A rotor blade in accordance with claim 8 further comprising a first channel that extends between a dovetail lower surface and said cast-in plenum first and second portions.

11. A rotor blade in accordance with claim 8 further comprising a first channel extending between a dovetail lower surface and a cast-in plenum first portion, and a second channel extending between said dovetail lower surface and a cast-in plenum second portion, said first and second channels extends along at least one of a platform upstream side and a platform downstream side.

12. A rotor blade in accordance with claim 8 wherein said rotor blade further comprises a first channel extending between a dovetail lower surface and a cast-in plenum first portion, and a second channel extending between said dovetail lower surface and a cast-in plenum second portion, said first channel extends along at least one of a platform upstream side and a platform downstream side, said second channel extends along at least one of said platform upstream side and said platform downstream side opposite said first channel.

13. A rotor blade in accordance with claim 8 wherein said first and third plenum portions comprise a first side that comprises a generally concave profile, and said second and fourth plenum portions comprise a first side that comprises a generally convex profile, said rotor blade further comprises a plurality of openings extending between said cast-in plenum and a platform outer surface, said plurality of openings sized to facilitate channeling a predetermined quantity of cooling air to said platform outer surface.

14. A gas turbine engine rotor assembly comprising:

a rotor; and a plurality of circumferentially-spaced rotor blades coupled to said rotor, each said rotor blade comprising:

a dovetail, a platform coupled to said dovetail, said platform comprising a cast-in plenum formed within said platform, said cast-in plenum comprising a first plenum portion, a second plenum portion, a third plenum portion that is coupled in flow communication with said first plenum portion, a fourth plenum portion that is coupled in flow communication with said second plenum portion, a first plurality of openings extending between said first plenum portion and said third plenum portion such that said first plenum portion is in flow communication with said third plenum portion, and a second plurality of openings extending between said second plenum portion and said fourth plenum portion such that said second plenum portion is in flow communication with said fourth plenum portion; and an airfoil coupled to said platform, and a cooling source coupled in flow communication to said cast-in plenum.

15. A gas turbine engine rotor assembly in accordance with claim 14 wherein said cast-in plenum further comprises a fifth plenum portion coupled in flow communication with said first and said second plenum portions, said fifth plenum portion coupled to said first and second plenum portions to define a substantially U-shaped plenum.

16. A gas turbine engine rotor assembly in accordance with claim 14 further comprising a first channel that extends between a dovetail lower surface and said cast-in plenum fifth portion.

17. A gas turbine engine rotor assembly in accordance with claim 14 wherein said turbine rotor blade further comprises a first channel extending between a dovetail lower surface and said cast-in plenum first portion, and a second channel extending between said dovetail lower surface and said cast-in plenum second portion, said first and second channels extends along at least one of a platform upstream side and a platform downstream side.

18. A gas turbine engine rotor assembly in accordance with claim 14 wherein said turbine rotor blade further comprises a first channel extending between a dovetail lower surface and said cast-in plenum first portion, and a second channel extending between said dovetail lower surface and said cast-in plenum second portion, said first channel extends along at least one of a platform upstream side and a platform downstream side, said second channel extends along at least one of said platform upstream side and said platform downstream side opposite said first channel.

19. A gas turbine engine rotor assembly in accordance with claim 14 wherein said first and third plenum portions comprise a first side that comprises a generally concave profile, and said second and fourth plenum portions comprise a first side that comprises a generally convex profile, said rotor blade further comprises a plurality of openings extending between said cast-in plenum and a platform outer surface, said plurality of openings sized to facilitate channeling a predetermined quantity of cooling air to said platform outer surface.

* * * * *